US008554565B2

(12) United States Patent
Nishiyama et al.

(10) Patent No.: US 8,554,565 B2
(45) Date of Patent: Oct. 8, 2013

(54) SPEECH SEGMENT PROCESSOR

(75) Inventors: Osamu Nishiyama, Kanagawa (JP); Takehiko Kagoshima, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 12 days.

(21) Appl. No.: 12/881,397

(22) Filed: Sep. 14, 2010

(65) Prior Publication Data

US 2011/0246199 A1 Oct. 6, 2011

(30) Foreign Application Priority Data

Mar. 31, 2010 (JP) ..... 2010-084319

(51) Int. Cl.
*G10L 13/00* (2006.01)

(52) U.S. Cl.
USPC ..... 704/258

(58) Field of Classification Search
USPC ..... 704/258–269
See application file for complete search history.

(56) References Cited

U.S. PATENT DOCUMENTS 7,630,898 B1 * 12/2009 Davis et al. ..... 704/266
7,979,280 B2 * 7/2011 Wouters et al. ..... 704/268
2003/0229494 A1 * 12/2003 Rutten et al. ..... 704/254
2008/0167875 A1 * 7/2008 Bakis et al. ..... 704/258
2010/0076768 A1 * 3/2010 Kato et al. ..... 704/266
2010/0312565 A1 * 12/2010 Wang et al. ..... 704/260

FOREIGN PATENT DOCUMENTS

JP A-2002-055693 2/2002
JP 2006-313176 A 11/2006
JP A-2007-148172 6/2007
JP A-2009-244661 10/2009

OTHER PUBLICATIONS

Background Art Information Sheet provided by applicants (Jul. 30, 2010) (1 page total).
Office Action mailed on Jan. 24, 2012 in the corresponding Japanese patent application No. 2010-084319 (English translation enclosed).

* cited by examiner

*Primary Examiner* — Douglas Godbold
*Assistant Examiner* — Ernest Estes
(74) *Attorney, Agent, or Firm* — Posz Law Group, PLC

(57) ABSTRACT

According to one embodiment, a speech synthesizer generates a speech segment sequence and synthesizes speech by connecting speech segments of the generated speech segment sequence. If a speech segment of a synthesized first speech segment sequence is different from the speech segment of a synthesized second speech segment sequence having the same synthesis unit as the first speech segment sequence, the speech synthesizer disables the speech segment of the first speech segment sequence that is different from the speech segment of the second speech segment sequence.

7 Claims, 17 Drawing Sheets

FIG.11A
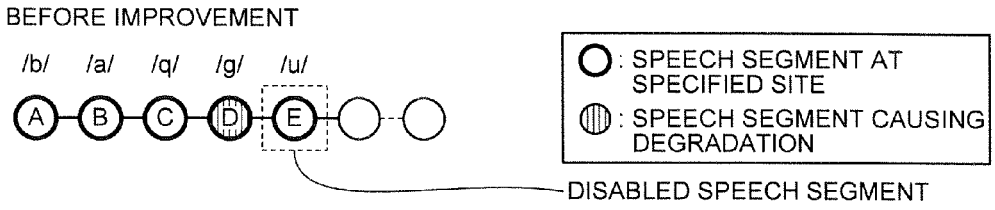
FIG.11B
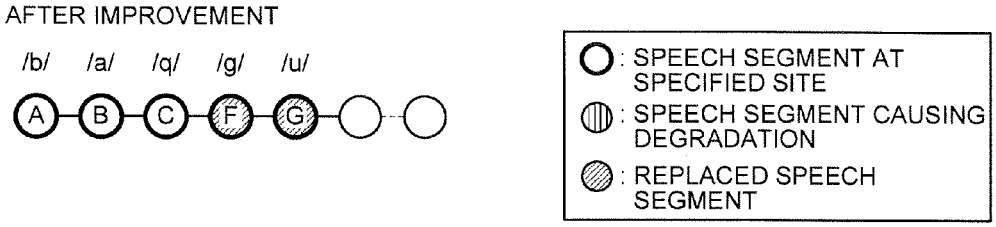
FIG.12
| SPEECH SEGMENT ID |
| --- |
| D |
| E |

FIG.15A
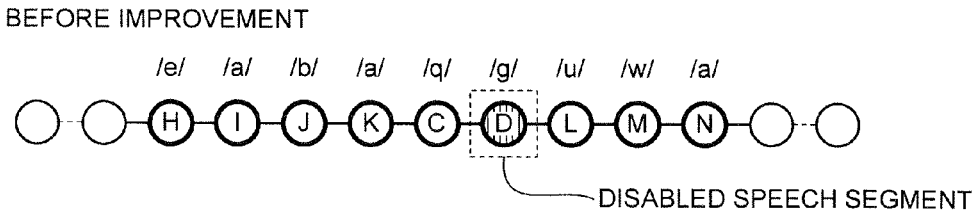
FIG.15B
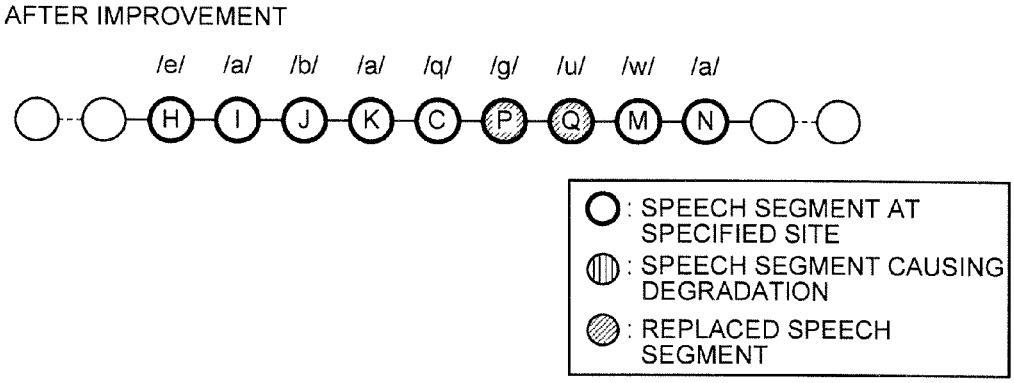
FIG.16
| SPEECH SEGMENT ID |
| --- |
| D |
| E |
| L |

FIG.18
| SPEECH SEGMENT ID | CHANGE COUNT |
|---|---|
| D | 2 |
| E | 1 |
| L | 1 |
FIG.19A
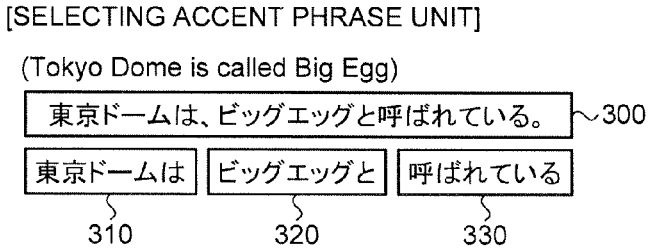
FIG.19B
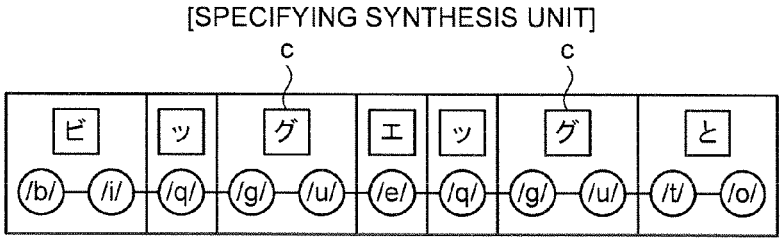
FIG.20
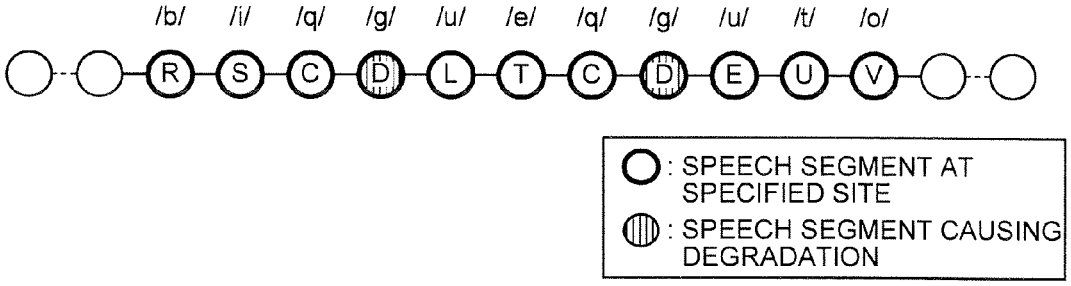

FIG.21A
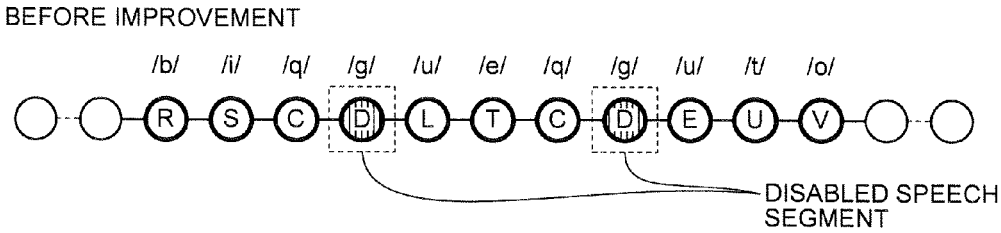
FIG.21B
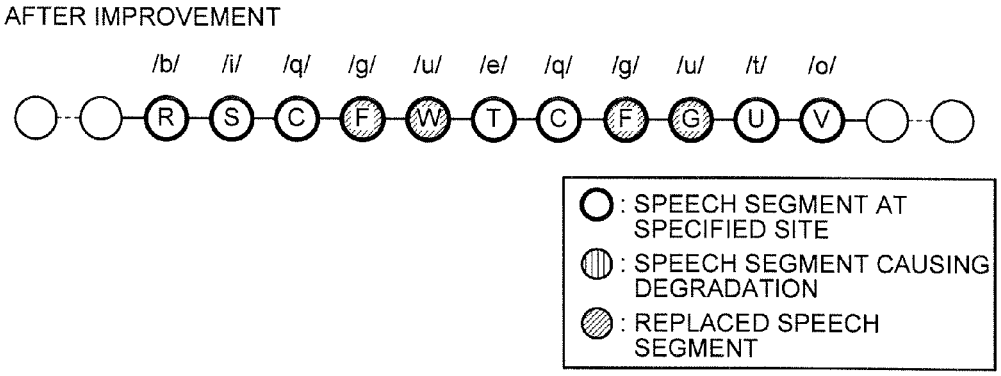
FIG.22
| SPEECH SEGMENT ID | CHANGE COUNT |
|---|---|
| D | 4 |
| E | 2 |
| L | 2 |

FIG.24
| SPEECH SEGMENT ID | PHONEMIC ENVIRONMENT |
|---|---|
| D | q-g-u |
| E | g-u-sil,t |
| L | g-u-w,e |
FIG.25A
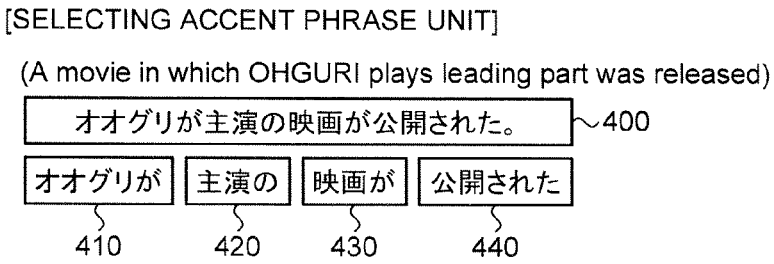
FIG.25B
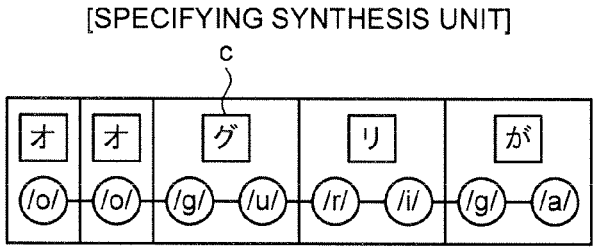
FIG.26
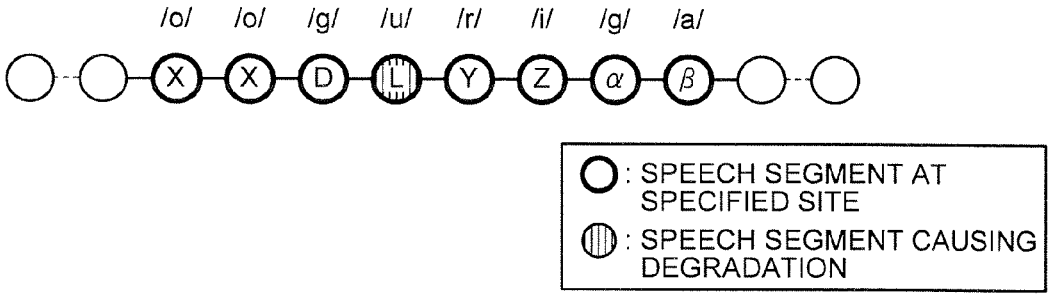

FIG.27A
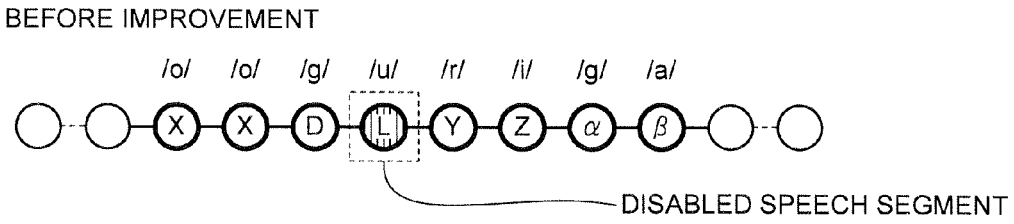
FIG.27B
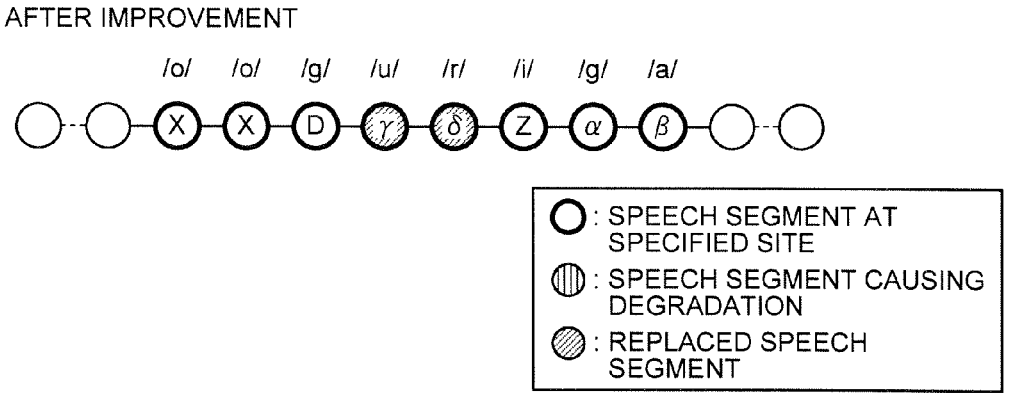
FIG.28
| SPEECH SEGMENT ID | PHONEMIC ENVIRONMENT |
|---|---|
| D | q-g-u |
| E | g-u-sil,t |
| L | g-u-w,e, r |
| Y | u-r-i |

SPEECH SEGMENT PROCESSOR

CROSS-REFERENCE TO RELATED APPLICATIONS

This application is based upon and claims the benefit of priority from Japanese Patent Application No. 2010-084319, filed on Mar. 31, 2010; the entire contents of which are incorporated herein by reference.

FIELD

Embodiments described herein relate generally to synthesis of speech.

BACKGROUND

In recent years, speech synthesizers capable of creating synthetic speech from intermediate output after the intermediate output that is output by the speech synthesizers being corrected by a user have been proposed. JP-A 2006-313176 (KOKAI) discloses a technology in which, when a user issues instructions to replace a speech segment constituting synthetic speech, a speech synthesizer adds the speech segment to a disabled speech segment list. The speech synthesizer carries out speech synthesis by referring to the disabled speech segment list to exclude speech segments recorded in the disabled speech segment list from the speech synthesis.

However, according to the technology of JP-A 2006-313176 (KOKAI), it is very difficult for the user to precisely specify a speech segment causing quality degradation of synthetic speech, and rather speech segments in the vicinity thereof are frequently specified. Thus, a technology that effectively disables speech segments causing quality degradation is demanded.

BRIEF DESCRIPTION OF THE DRAWINGS

FIG. 11A is a diagram illustrating a speech segment sequence before being improved;

FIG. 11B is a diagram illustrating the speech segment sequence after being improved;

FIG. 12 is a diagram illustrating speech segments stored in a change segment history storage unit;

FIGS. 15A and 15B are diagrams illustrating speech segment sequences used at a degraded site;

FIG. 16 is a diagram illustrating a speech segment stored in the change segment history storage unit;

FIG. 18 is a diagram illustrating speech segments stored in the change segment history storage unit;

FIG. 19A is a diagram illustrating word (accent) delimited text;

FIG. 19B is a diagram illustrating a disabled speech segment sequence used at a degraded site;

FIG. 20 is a diagram illustrating a speech segment sequence corresponding to a word (an accent phrase);

FIGS. 21A and 21B are diagrams illustrating speech segment sequences used at a degraded site;

FIG. 22 is a diagram illustrating a speech segment stored in the change segment history storage unit;

FIG. 24 is a diagram illustrating speech segments stored in the change segment history storage unit;

FIG. 25A is a diagram illustrating word (accent) delimited text;

FIG. 25B is a diagram illustrating a disabled speech segment sequence used at a degraded site FIG. 26 is a diagram illustrating a speech segment sequence corresponding to a word (an accent phrase);

FIGS. 27A and 27B are diagrams illustrating speech segment sequences used at a degraded site;

FIG. 28 is a diagram illustrating speech segments stored in the change segment history storage unit.

DETAILED DESCRIPTION

In general, according to one embodiment, a speech synthesizer includes a generation unit that selects speech segments for respective synthesis units to generate a speech segment sequence, which is a sequence of the speech segments; a speech connection unit that synthesizes speech by connecting the speech segments of the speech segment sequence generated by the generation unit; and a prohibition unit that disables, if a speech segment of a first speech segment sequence synthesized by the speech connection unit is different from a speech segment of a second speech segment sequence, which is synthesized by the speech connection unit and has the same synthesis unit as the first speech segment sequence, the speech segment of the first speech segment sequence that is different from the speech segment of the second speech segment sequence.

Exemplary embodiments of a speech synthesizer will be described below with reference to the appended drawings.

(First Embodiment)

Figure 1:
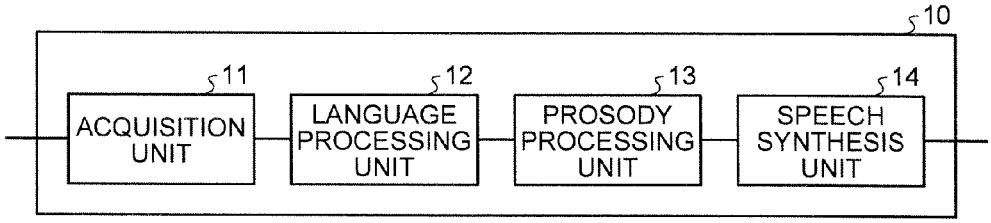
FIG. 1 is a block diagram illustrating a configuration of a speech synthesizer according to a first embodiment.

FIG. 1 is a block diagram illustrating the configuration of a speech synthesizer according to a first embodiment. A speech synthesizer 10 includes an acquisition unit 11, a language processing unit 12, a prosody processing unit 13, and a speech synthesis unit 14. The acquisition unit 11 acquires text data intended for speech synthesis from inside or outside the speech synthesizer 10. The language processing unit 12 performs morphological analysis/syntax analysis on the acquired text data. The prosody processing unit 13 outputs a speech segment sequence constituted by a plurality of synthesis units based on the prosody such as stress of the text data and attributes regarding the language such as the noun to the speech synthesis unit 14. The speech synthesis unit 14 generates synthetic speech by using the speech segment sequence.

Each synthesis unit has a phoneme symbol, prosodic information, and language information about text containing a section corresponding thereto. The synthetic speech is represented by a speech segment sequence. The prosodic information contains, for example, the fundamental frequency, phoneme duration, Mel-Cepstral Coefficients, and power. The language information contains, for example, words, the number of syllables in a word, word corresponding to each synthesis unit, position of each synthesis unit in a word measured in a syllable, and flag indicating whether a syllable in which each synthesis unit is contained is a stressed one or not.

Figure 2:
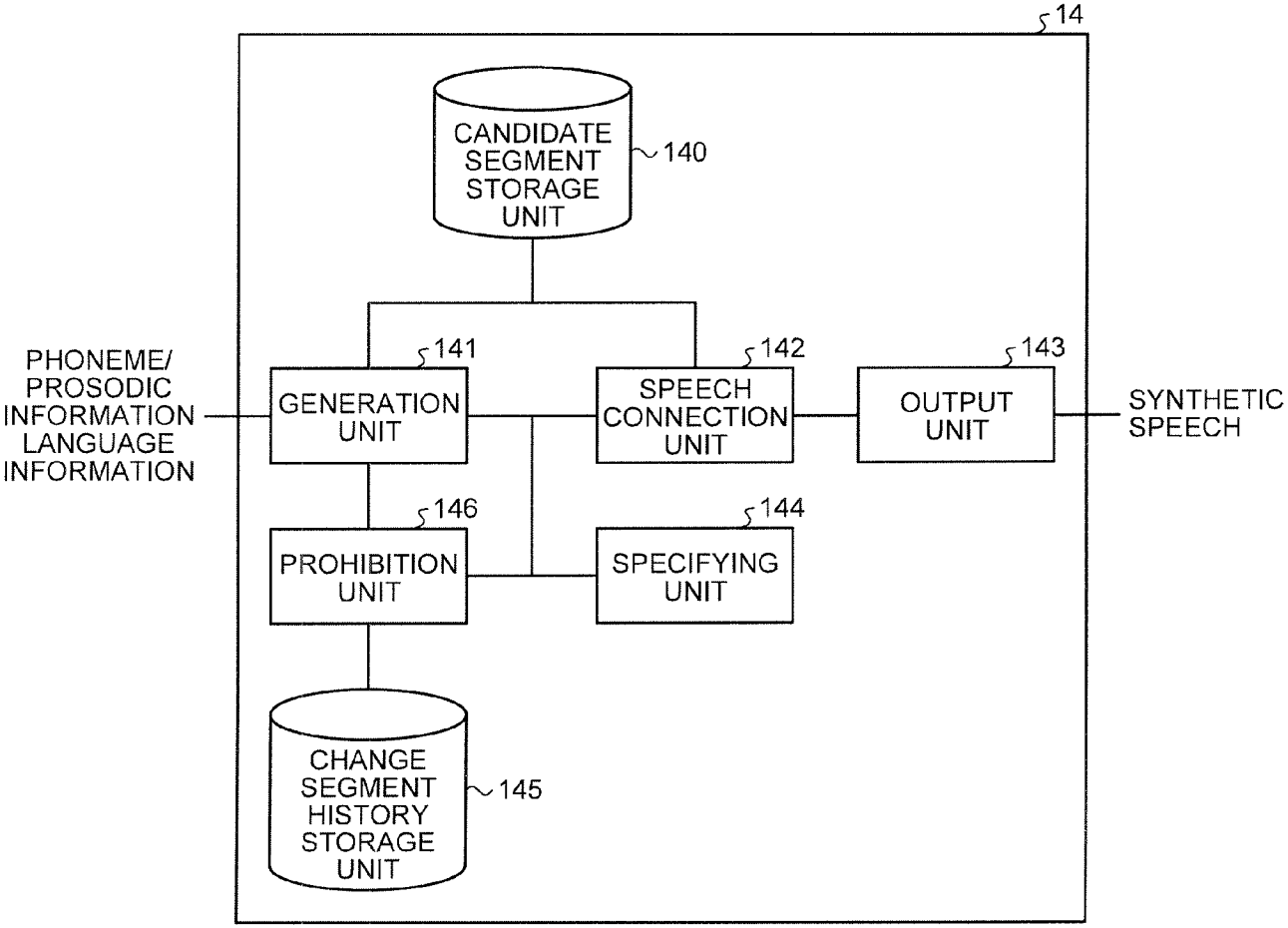
FIG. 2 is a block diagram illustrating the configuration of a synthetic speech unit.

FIG. 2 is a block diagram illustrating the configuration of the speech synthesis unit 14. The speech synthesis unit 14 includes a candidate segment storage unit 140, a generation unit 141, a speech connection unit 142, an output unit 143, a specifying unit 144, a change segment history storage unit 145, and a prohibition unit 146. The candidate segment storage unit 140 stores speech segments that could become candidates for selection. The generation unit 141 selects speech segments for each synthesis unit from speech segments stored in the candidate segment storage unit 140 so that speech segments prohibited by the prohibition unit 146 are not selected for the site specified by the specifying unit 144. The speech connection unit 142 synthesizes speech by using speech segments selected by the generation unit 141. The output unit 143 outputs synthetic speech synthesized by the speech connection unit 142. The specifying unit 144 allows the user to determine whether quality of speech synthesis passes or fails a test and, if quality thereof is insufficient, to specify such sites. The change segment history storage unit 145 stores therein speech segments changed before and after quality improvement and predetermined accompanying information. The prohibition unit 146 decides speech segments that should not be selected for sites where quality is designated by the specifying unit 144 to be insufficient based on information stored in the change segment history storage unit 145.

Figure 3:
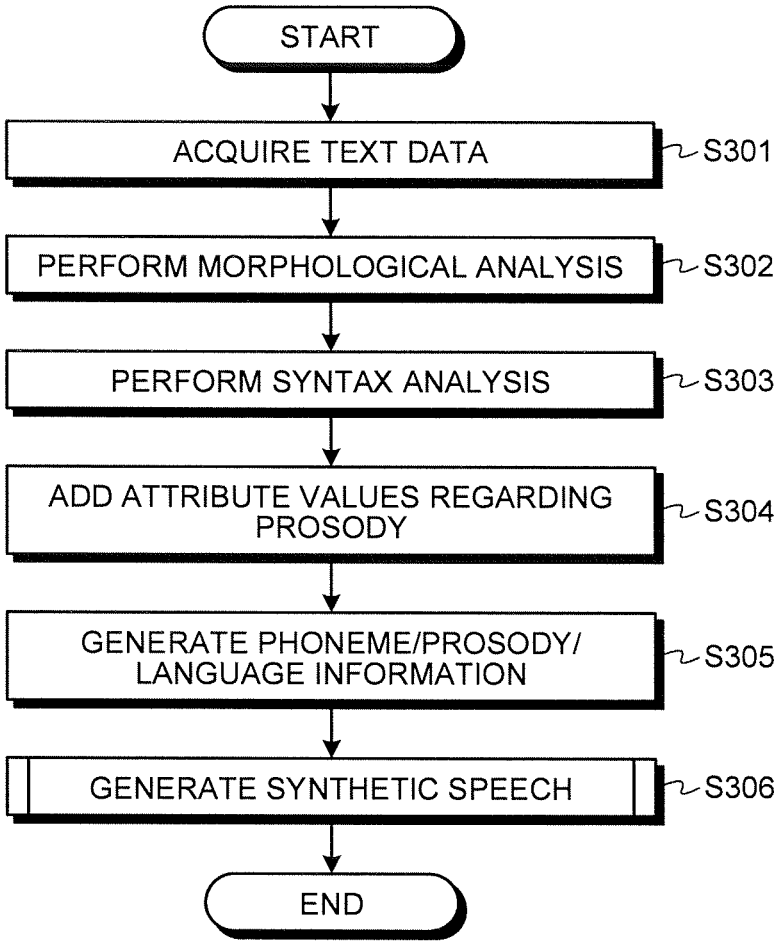
FIG. 3 is a diagram illustrating a flow chart showing an operation of the speech synthesizer.

The operation of the speech synthesizer 10 will be described with reference to FIG. 3. FIG. 3 is a diagram illustrating a flow chart representing the operation of the speech synthesizer 10.

In step S301, the acquisition unit 11 acquires text data intended for speech synthesis from inside or outside the speech synthesizer 10.

In step S302, the language processing unit 12 divides the text data acquired by the acquisition unit 11 into morphemes by performing morphological analysis on the text data. This step may be omitted for languages that are not an agglutinative language.

In step S303, the language processing unit 12 performs syntax analysis on a sequence of divided morphemes to assign attribute values such as reading information, the part of speech, conjugation, and dependency between morphemes to each morpheme.

In step S304, the language processing unit 12 adds attribute values regarding the prosody such as a phoneme symbol string, position of stressed syllables and their strength to each morpheme of the sequence of morphemes having the attribute values assigned in step S303 based on the assigned attribute values.

In step S305, the prosody processing unit 13 generates prosodic information to be a target of synthetic speech for each synthesis unit based on the attribute values assigned and added to each morpheme in step S303 and S304 to generate a synthesis unit sequence constituted by a plurality of synthesis units each having a phoneme symbol, prosodic information, and language information. The present embodiment is described by taking a case in which a phoneme is the synthesis unit as an example, but the present invention is not limited to this.

In step S306, the speech synthesis unit 14 generates synthetic speech from the synthesis unit sequence generated in step S305. If a database used for analysis or acquisition of necessary data is needed in steps S301 to S304, such a database may be provided.

Figure 4:
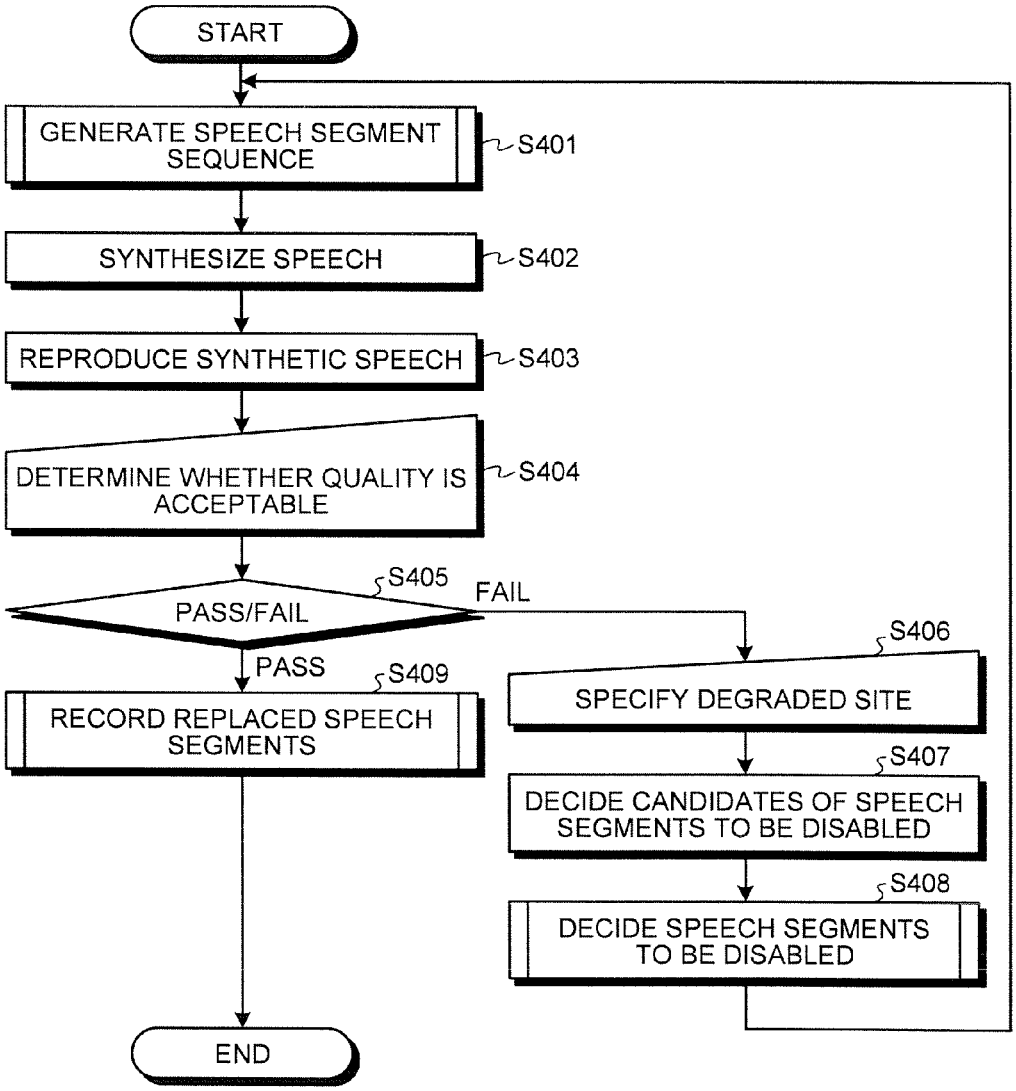
FIG. 4 is a diagram illustrating the flow chart showing the operation of a connection unit.

Next, the operation of the speech synthesis unit 14 will be described with reference to FIGS. 4 to 6. FIG. 4 is a diagram illustrating the flow chart representing a detailed operation in step S306.

In step 8401, the generation unit 141 generates a speech segment sequence constituted by a plurality of speech segments for each synthesis unit of the synthesis unit sequence generated in step S305 by selecting optimal speech segments from those stored in the candidate segment storage unit 140 without selecting speech segments decided by the prohibition unit 146 for each synthesis unit of a partial sequence of the synthesis unit specified by the specifying unit 144.

In step S402, the speech connection unit 142 synthesizes speech by using the speech segment sequence generated in step S401.

In step S403, the output unit 143 reproduces the synthetic speech generated in step S402. Next, the specifying unit 144 presents information to enable the user to specify sites where quality of synthetic speech is insufficient.

In step S404, the specifying unit 144 accepts a pass/fail result indicating whether quality of synthetic speech is acceptable or insufficient through input from the user.

In step S405, the specifying unit 144 branches off processing depending on the pass/fail result input by the user in step S404. If quality thereof is acceptable ("pass" in step S405), the processing proceeds to step S409. If quality thereof is insufficient ("fail" in step S405), the processing proceeds to step S406.

In step S406, the specifying unit 144 allows the user to specify degraded sites through input from the user.

In step S407, the specifying unit 144 decides candidates of speech segments to be disabled. More specifically, the specifying unit 144 determines a partial sequence of synthesis units corresponding to sites specified in step S406 and a partial sequence of speech segments selected from the partial sequence of the synthesis units.

In step S408, the prohibition unit 146 decides, for each synthesis units the partial sequence of synthesis units determined in step S407, speech segments to be disabled based on information recorded in the change segment history storage unit 145.

In step S409, the prohibition unit 146 compares, with respect to the same sentence, between the last speech segment sequence and the speech segment sequence of this time that are selected in step S401. The prohibition unit 146 also records identifiers specific to replaced speech segments in the change segment history storage unit 145.

Details of step S401 in FIG. 4 will be described with reference to FIG. 5.

In step S501, the generation unit 141 checks for each of the synthesis units whether the prohibition unit 146 has decided speech segment to be disabled. If there is any speech segment to be disabled ("YES" in step S501), the processing proceeds to step S502 and if there is no speech segment to be disabled ("NO" in step S501), the processing proceeds to step S503.

In step S502, the generation unit 141 excludes disabled speech segments to narrow down candidates of speech segments for each synthesis unit in advance.

In step S503, the generation unit 141 reads speech segments appropriate for the synthesis unit from the candidate segment storage unit 140 to preliminarily select a predetermined number of speech segments by comparing phoneme information, prosodic information, and language information held by the synthesis unit and the same kinds of information held by each speech segment. The processing of steps S501 to S503 is performed for all synthesis units. A conventional method may be used as the comparison method in step S503 with necessary information being supplied when needed.

In step S504, the generation unit 141 actually selects one speech segment for each synthesis unit from a plurality of speech segments selected for each synthesis unit in consideration of the degree of appropriateness of connection between each speech segment of adjacent synthesis units and a difference between a target value of the information calculated in step S503 and held by each synthesis unit and a value of the same kind of information held by each speech segment. A conventional method may be used as the method of calculating appropriateness of connection in step S504 with necessary information being supplied when needed.

Details of step S408 in FIG. 4 will be described with reference to FIG. 6.

The prohibition unit 146 performs step S601 and step S602 below for each speech segment of the speech segment sequence determined in step S407.

In step S601, the prohibition unit 146 checks whether any speech segment is recorded in the change segment history storage unit 145 before branching off processing. If no speech segment is recorded ("NO" in step S601), the processing proceeds to step S603. If any speech segment is recorded ("YES" in step S601), the processing proceeds to step S602.

In step S602, the prohibition unit 146 stores such speech segments as speech segments (disabled speech segments) not to be used in the synthesis unit. When the above processing is completed for all speech segments, the processing moves to step S603.

In step S603, the prohibition unit 146 branches off processing depending on whether any disabled speech segment is recorded. If any disabled speech segment is recorded ("YES" in step S603), the processing moves to the next processing (step S401 in FIG. 4) without processing in step S604 and step S605 being performed. If no disabled speech segment is recorded ("NO" in step S603), the processing proceeds to step S604.

In step S604, the specifying unit 144 requests the user to select at least one speech segment to be disabled from the speech segment sequence determined in step S407 of FIG. 4.

In step S605, the prohibition unit 146 stores, like step S602, such a speech segment selected as a speech segment (disabled speech segment) not to be used. Speech segments recorded as speech segments (disabled speech segments) not to be used in step S602 or step S605 in this manner are referred to in step S501 of FIG. 5 and are not selected for the corresponding synthesis unit in step S502 of FIG. 5. Therefore, when the next synthetic speech is created, synthetic speech that does not use such speech segments will be created.

The operation of the speech synthesis unit 14 of a speech synthesizer according to the first embodiment will be described in detail with reference to FIGS. 7 to 14. It is assumed that the change segment history storage unit 145 is in an initial state without anything being recorded. The description begins after the user enters, for example, Japanese text 100 as illustrated in FIG. 7 (in English, it means that "please put baggage such as a bag and a rucksack into a storage box") and listens to synthetic speech thereof to specify that quality thereof is not acceptable via the specifying unit 144.

Figure 7:
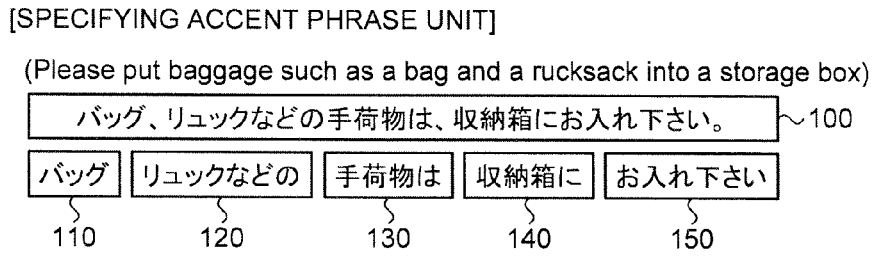
FIG. 7 is a diagram illustrating words (because "accent phrase" in Japanese is not common in English, "accent phrase" is hereinafter referred to as "word") delimited text.

In step S406, as illustrated in FIG. 7, the specifying unit 144 displays word delimited text, i.e., words 110, 120, 130, 140, and 150, and makes an inquiry at the user about which word has insufficient quality to allow the user to specify such a word.

Figure 8:
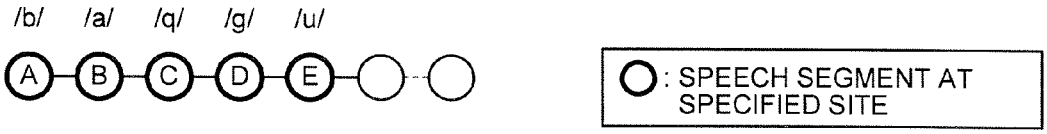
FIG. 8 is a diagram illustrating a speech segment sequence corresponding to a word (an accent phrase)

In step S407, as illustrated in FIG. 8, the specifying unit 144 derives a speech segment sequence corresponding to the selected word. It is assumed here that the word 110 ("bag" in English) as illustrated in FIG. 7 is selected in step S406. In FIG. 8, speech segments A, B, C, D, and E are selected for each synthesis unit (phoneme), /b/ (consonant of a syllable "a"), /a/ (vowel of a syllable "a"), /q/ (a syllable (mora phoneme) "b"), /g/ (consonant of a syllable "c"), and /u/ (vowel of a syllable "c") respectively.

Next, in step S601, the prohibition unit 146 refers to the change segment history storage unit 145 in a state (initial state) in which nothing is recorded, which yields "NO" in step S601 and the processing proceeds to step S603. Since there is no disabled segment here, the processing proceeds to step S604.

Figure 9:
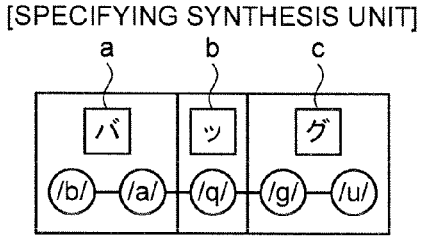
FIG. 9 is a diagram illustrating a speech segment sequence used at a degraded site.

In step S604, as illustrated in FIG. 9, the specifying unit 144 displays a speech segment sequence used at a degraded site to allow the user to select the speech segment to be disabled by causing the user to specify a synthesis unit. It is assumed here that the user selects the speech segment of the synthesis unit /u/ corresponding to the vowel of the syllable "c".

Figure 10:
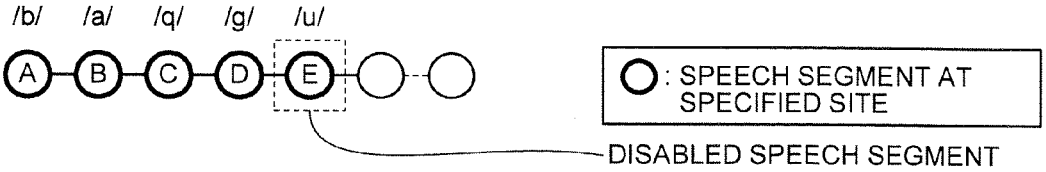
FIG. 10 is a diagram illustrating a disabled speech segment.

In step S605, as illustrated in FIG. 10, the prohibition unit 146 stores the speech segment E selected in step S604 as a disabled speech segment.

Next, after returning to step S401, the speech synthesis unit 14 creates synthetic speech again.

First, in step S501, the generation unit 141 proceeds to step S502 because the speech segment E is recorded as a disabled speech segment ("YES" in step S501) for the synthesis unit /u/ corresponding to the vowel of the syllable "c" of the word 111 ("bag" in English).

In step S502, the generation unit 141 excludes the speech segment E from targets to be preliminary selected (step S503) for the synthesis unit.

In step S503, the generation unit 141 performs preliminary selection.

As a result of performing step S501 to step S503 for each synthesis unit, in contrast to the last synthetic speech creation, subsequent processing proceeds and synthetic speech is presented to the user without the speech segment E being selected for the synthesis unit /u/ corresponding to the vowel of the syllable "c" of the word 111 ("bag" in English).

Next, a case where the user finds quality thereof acceptable in step S404 and the speech synthesis unit 14 moves the processing to step S409 will be described.

In step S409, as illustrated in FIGS. 11A and 11B, the prohibition unit 146 compares the speech segment sequence before being improved (FIG. 11A) and that after being improved (FIG. 11B). The prohibition unit 146 records the replaced speech segment D and speech segment E in the change segment history storage unit 145 (FIG. 12).

It is assumed that FIGS. 11A and 11B are calculated as follows. In step S604, the user could not identify the speech segment D that caused quality degradation of the word 110 ("bag" in English) and speech synthesis was performed again by disabling the speech segment E. However, in the actual selection in step S504, the speech segment D of the synthesis unit of the consonant /g/ in the syllable "c" is not selected because the speech segment E is not contained as a candidate of the synthesis unit of the consonant /g/ in the syllable "c", which leads to a lower assessment of appropriateness of connection between speech segments of different synthesis units. Due to such a side effect, quality of the synthetic speech happens to be improved.

In the present embodiment, even if the user cannot identify a speech segment causing quality degradation, replaced speech segments are all recorded when the user recognizes quality improvement. Thus, recorded speech segments contain a defective speech segment that caused quality degradation. By referring to records thereof, it becomes possible to prevent the same defective speech segment from being selected in synthetic speech for other text.

A concrete example of the method of using the above history will be described with reference to FIGS. 13 to 16. It is assumed that the change segment history storage unit 145 is in a state of FIG. 12. The description begins after the user enters, for example, Japanese text 200 (in English, it means that "ABS and an air bag are provided as standard equipment") and listens to synthetic speech thereof to specify that quality thereof is not acceptable and specify a word 220 as a degraded site (FIG. 13A) among words 210, 220, 230, 240, and 250 via the specifying unit 144.

Figure 14:
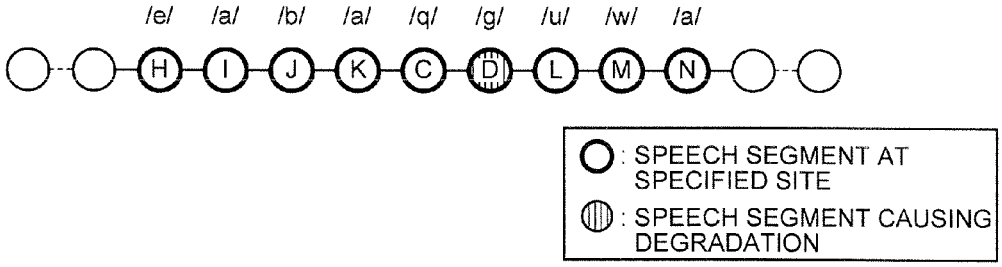
FIG. 14 is a diagram illustrating a speech segment sequence corresponding to a word (an accent phrase)

In step S407, the specifying unit 144 decides candidates of speech segments to be disabled. More specifically, as illustrated in FIG. 14, the specifying unit 144 identifies a partial sequence of speech segments H, I, J, K, C, D, L, M, and N corresponding to the word 220. It is assumed here that the speech segment D caused quality degradation.

In step S601, the prohibition unit 146 checks whether any speech segment is recorded in the change segment history storage unit 145 in a state of FIG. 12.

Figure 13A:
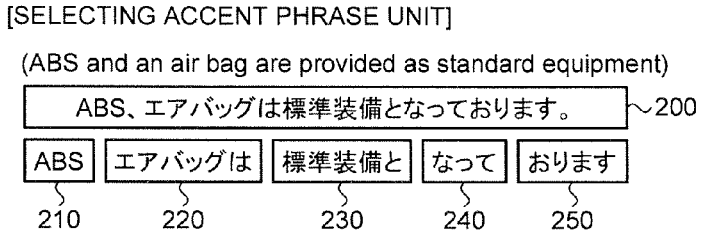
FIG. 13A is a diagram illustrating word (accent) delimited text.
Figure 13B:
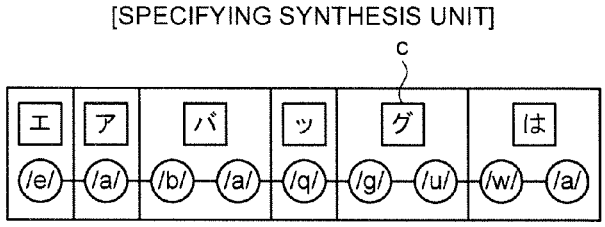
FIG. 13B is a diagram illustrating a disabled speech segment sequence used at a degraded site.

In step S602, the prohibition unit 146 stores the speech segment D selected for the consonant /g/ of the syllable "c" as illustrated in FIG. 13B as a speech segment (disabled speech segment) not to be used for the synthesis unit. Hereinafter, the prohibition unit 146 has the disabled speech segment decided and recorded therein and thus, in step S603, moves the processing to step S401.

Hereinafter, as shown in FIGS. 15A and 15B, synthetic speech is created (step S402) without at least the defective speech segment D being selected for the consonant /g/ of the syllable "c" (step S401) through processing similar to that in the embodiment described above, to present the synthetic speech to the user (step S403). Thus, in the present embodiment, even if the user cannot identify the defective speech segment that caused degradation in previous improvement work of synthetic speech, quality degradation caused by the same speech segment as before can be avoided without the need for the user to identify the cause (speech segment) thereof again with a precision of the synthesis unit.

If the user finds quality of the synthetic speech created and presented in this manner acceptable (step S405), the prohibition unit 146 adds the newly added speech segment L of the replaced speech segment D and speech segment L to the change segment history storage unit 145 (step S409), which looks as illustrated in FIG. 16.

Thus, according to the present embodiment, speech segments replaced when the user recognizes quality improvement are all recorded and thus, a defective speech segment that caused quality degradation is always contained in the history thereof. Therefore, even if the user cannot identify the defective speech segment that caused degradation in previous improvement work of synthetic speech, quality degradation caused by the same speech segment as before can be avoided without the need for the user to identify the cause (speech segment) thereof again with a precision of the synthesis unit.

(Second Embodiment)

The second embodiment will be described. The description here centers on processing that is different from that in the first embodiment and similar processing is omitted when appropriate.

In the present embodiment, the change segment history storage unit 145 has, in addition to the identifier specific to a speech segment shown in the first embodiment, the count (change count) of replacement before and after the user recognizes quality improvement recorded therein by being associated with each speech segment. Because accompanying information such as the change count is recorded and updated, processing content in step S409 (FIG. 4) by the prohibition unit 146 is also different from that in the first embodiment. That is, if, in step S405 of FIG. 4, the user finds that quality of synthetic speech is acceptable (pass), the prohibition unit 146 compares the last speech segment sequence for the same sentence selected in step S401 and the speech segment sequence of this time. Then, with respect to the replaced speech segments, in addition to recording the identifier capable of uniquely identifying each replaced speech segment in the change segment history storage unit 145, the prohibition unit 146 sets the change count to 1 and records the change count if recorded for the first time and updates the change count if any speech segment is recorded in the change segment history storage unit 145.

Figure 17:
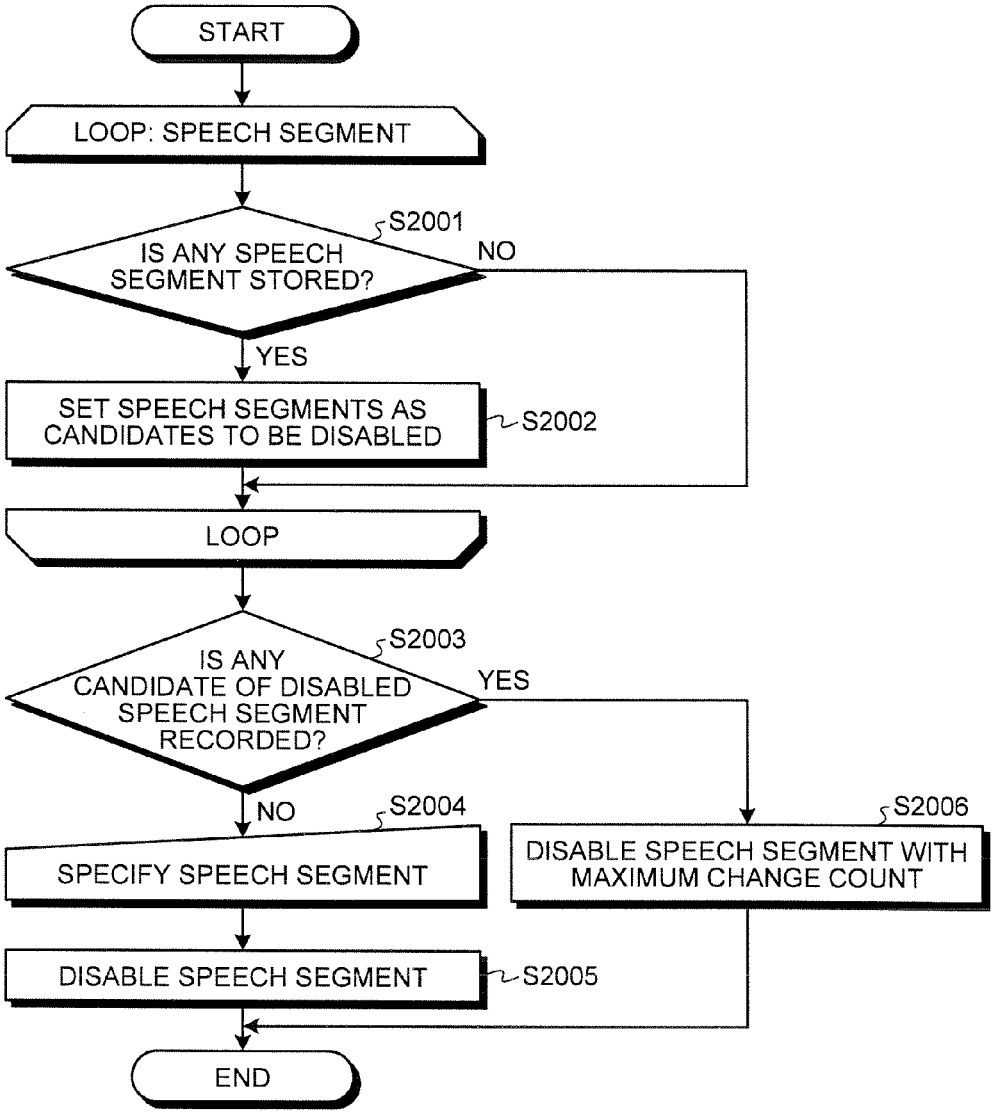
FIG. 17 is a diagram illustrating the flow chart showing the operation in step S408 of the connection unit according to a second embodiment.

FIG. 17 is a diagram illustrating the flow chart explaining step S408 in FIG. 4 according to the present embodiment.

The prohibition unit 146 performs step S2001 and step S2002 below for each speech segment of the speech segment sequence determined in step S407.

In step S2001, the prohibition unit 146 checks whether any speech segment is recorded in the change segment history storage unit 145 before branching off processing. If any speech segment is recorded ("YES" in step S2001), the processing proceeds to step S2003. If no speech segment is recorded ("NO" in step S2001), the processing proceeds to step S2002.

In step S2002, the prohibition unit 146 stores such speech segments as candidates of speech segments (disabled speech segments) not to be used in the synthesis unit. When the above processing is completed for all speech segments, the processing proceeds to step S2003.

In step S2003, the prohibition unit 146 branches off processing depending on whether any candidate of disabled speech segment is recorded. If any candidate of disabled speech segment is recorded ("YES" in step S2003), the processing moves to step S2006. If no candidate of disabled speech segment is recorded ("NO" in step S2003), the processing proceeds to step S2004.

In step S2004, like in the first embodiment, the specifying unit 144 requests the user to select from the speech segment sequence determined in step S407 of FIG. 4 so that at least one speech segment is set as a disabled speech segment.

In step S2005, the prohibition unit 146 stores such a speech segment disabled by the user in step S2004 as a disabled speech segment.

In step S2006, the prohibition unit 146 selects from candidates stored in step S2002 a candidate with the maximum change count among candidates recorded in the change segment history storage unit 145 and records the candidate as a speech segment (disabled speech segment) not to be used in the synthesis unit thereof. The change count of a candidate that is not recorded in the change segment history storage unit 145 may be treated with 0. If a plurality of candidates with the maximum change count is present, such candidates may be all recorded or a candidate may be selected from such candidates by using another criterion such as the head of a list.

Figure 5:
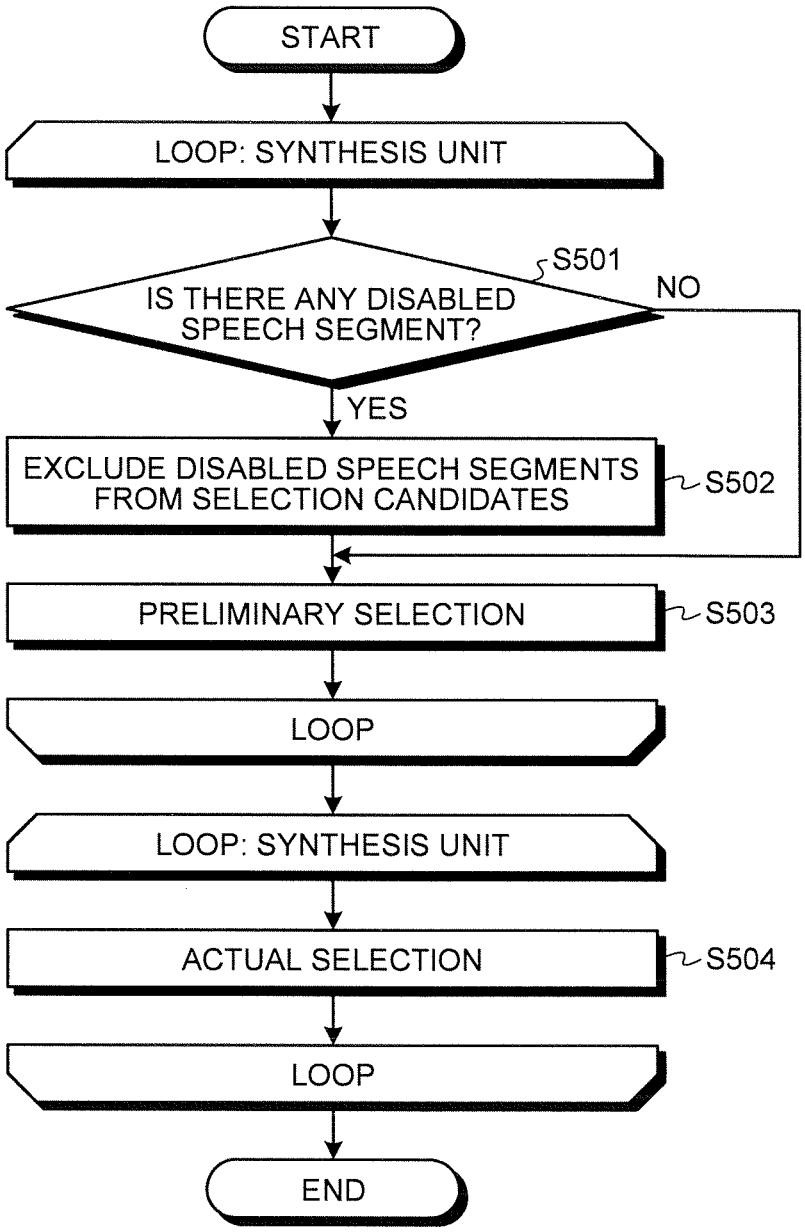
FIG. 5 is a diagram illustrating the flow chart showing the operation in step S401 of the connection unit.

Disabled speech segments recorded in step S2005 and step S2006 in this manner are referred to in step S501 of FIG. 5 and are not selected for the corresponding synthesis unit in step S502 of FIG. 5. Therefore, like in the first embodiment, when the next synthetic speech is created, synthetic speech that does not use such speech segments will be created.

A concrete example of the change segment history storage unit 145 and the prohibition unit 146 will be described with reference to FIGS. 18, 19A, 19B, 20A and 21B. It is assumed that the change segment history storage unit 145 is in a state after a concrete example in the first embodiment being carried out in the present embodiment and in a state of FIG. 18. The description begins after the user enters, for example, Japanese text 300 as illustrated in FIG. 19A (in English, it means that "Tokyo Dome is called Big Egg") subsequent to the Japanese text 10 as illustrated in FIG. 7 and the Japanese text 200 as illustrated in FIG. 13A and listens to synthetic speech thereof to specify that quality thereof is not acceptable and specify a word 320 as a degraded site (FIG. 19A) among words 310, 320, and 330 via the specifying unit 144.

In step S407, as illustrated in FIG. 20, the specifying unit 144 identifies a partial sequence of speech segments R, S, C, D, L, T, C, D, E, U and V corresponding to the word 320. It is assumed here that the defective speech segment D caused quality degradation.

In step S2001, the prohibition unit 146 checks whether any speech segment is recorded in the change segment history storage unit 145 before branching off processing. If no speech segment is recorded ("NO" in step S2001), the processing proceeds to step S2003. If any speech segment is recorded ("YES" in step S2001), the processing proceeds to step S2002.

In step S2002, the prohibition unit 146 refers to, for example, the change segment history storage unit 145 in the state of FIG. 18 to store speech segments D, L, and E as candidates of speech segments (disabled speech segments) not to be used in the synthesis unit for which each speech segment is selected.

In step S2003, the prohibition unit 146 proceeds to step S2006 because candidates of disabled speech segments are recorded ("YES" in step S2003). Incidentally, if no candidate of disabled speech segment is recorded ("NO" in step S2003), the processing proceeds to step S2004.

Figure 6:
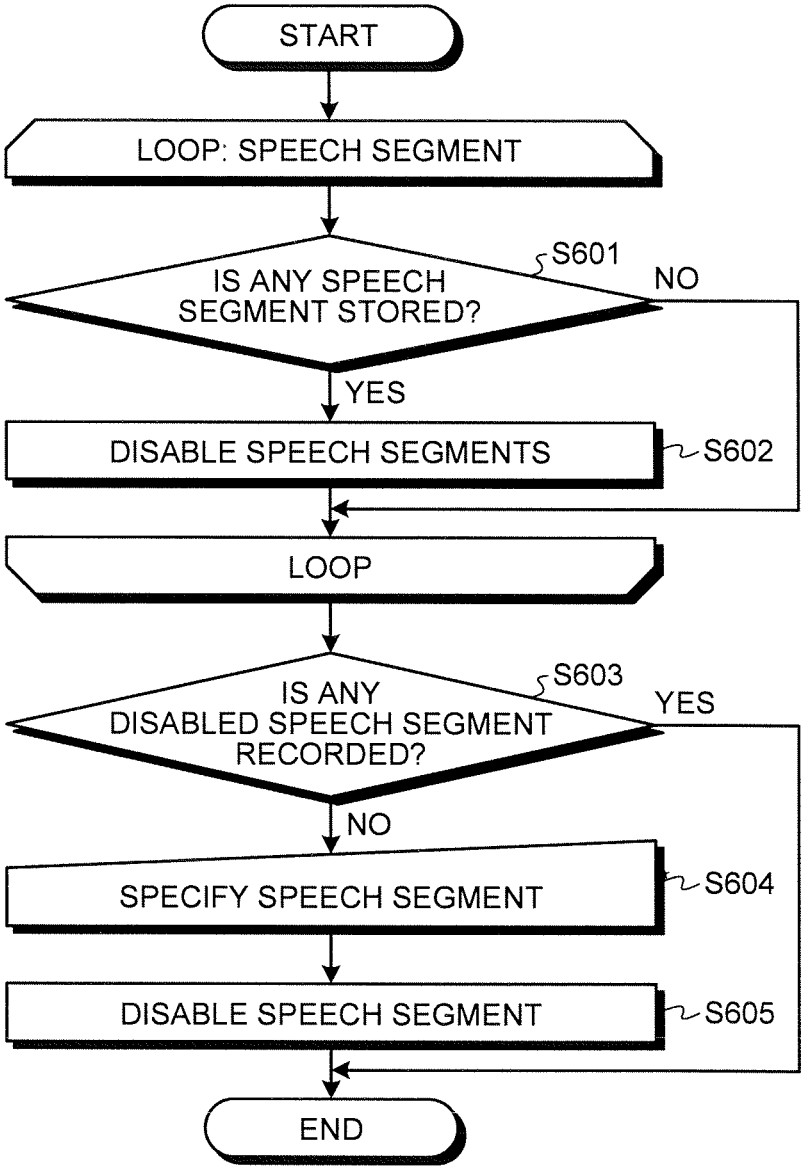
FIG. 6 is a diagram illustrating the flow chart showing the operation in step S408 of the connection unit.

Step S2004 and step S2005 are the same as step S604 and step S605 in FIG. 6 respectively and therefore, the description thereof is omitted.

In step S2006, the prohibition unit 146 refers to the change segment history storage unit 145 in the state of FIG. 18 to compare the change counts of the candidates. Since the change counts of the speech segments D, L, and E are 2, 1, and 1, respectively, the prohibition unit 146 decides and stores the speech segment D as a disabled speech segment.

Hereinafter, synthetic speech is created, like in FIG. 21B, by being replaced with the speech segments F, W, and G (corresponding to step S402) without, like in FIG. 21A, the defective speech segments D being selected at least in the consonant /g/ of the syllables "c" (FIG. 19B) (corresponding to step S401) through processing similar to that in the first embodiment described above before the synthetic speech being presented to the user in step S403. If the user finds the synthetic speech created/presented in this manner acceptable (corresponding to step S405), the prohibition unit 146 updates, like in FIG. 22, the change count of the speech segment D, among the replaced speech segments D, E, and L, from 2 to 4, that of the speech segment L and the speech segment E from 1 to 2.

Thus, according to a speech synthesizer in the second embodiment, speech segments replaced when the user recognizes quality improvement are all recorded and also the count of improvement due to replacement of the speech segments is also recorded as accompanying information. A speech segment whose count of quality improvement due to non-use thereof is large is preferentially disabled. Accordingly, the accuracy with which the use of a speech segment causing quality degradation common in many synthetic speeches is avoided can be increased.

(Third Embodiment)

The third embodiment will be described. The description here centers on processing that is different from that in the first embodiment and similar processing is omitted when appropriate.

In the present embodiment, the change segment history storage unit 145 has, in addition to the identifier specific to a speech segment shown in the first embodiment, information about a phonemic environment in which the speech segment is used recorded therein by being associated with each speech segment. Because accompanying information such as the information about the phonemic environment is recorded/updated, processing content in step S409 (FIG. 4) by the prohibition unit 146 is also different from that in the first embodiment. That is, if, in step S405 of FIG. 4, the user finds that quality of synthetic speech is acceptable (pass), the prohibition unit 146 compares the last speech segment sequence for the same sentence selected in step S401 and the speech segment sequence of this time. Then, with respect to the replaced speech segments, in addition to recording the identifier capable of uniquely identifying each replaced speech segment in the change segment history storage unit 145, the prohibition unit 146 records information about the phoneme of the synthesis unit for which the speech segment is selected and adjacent synthesis units thereof. If any speech segment is recorded in the change segment history storage unit 145, information thereof is updated in the form of addition thereto.

Figure 23:
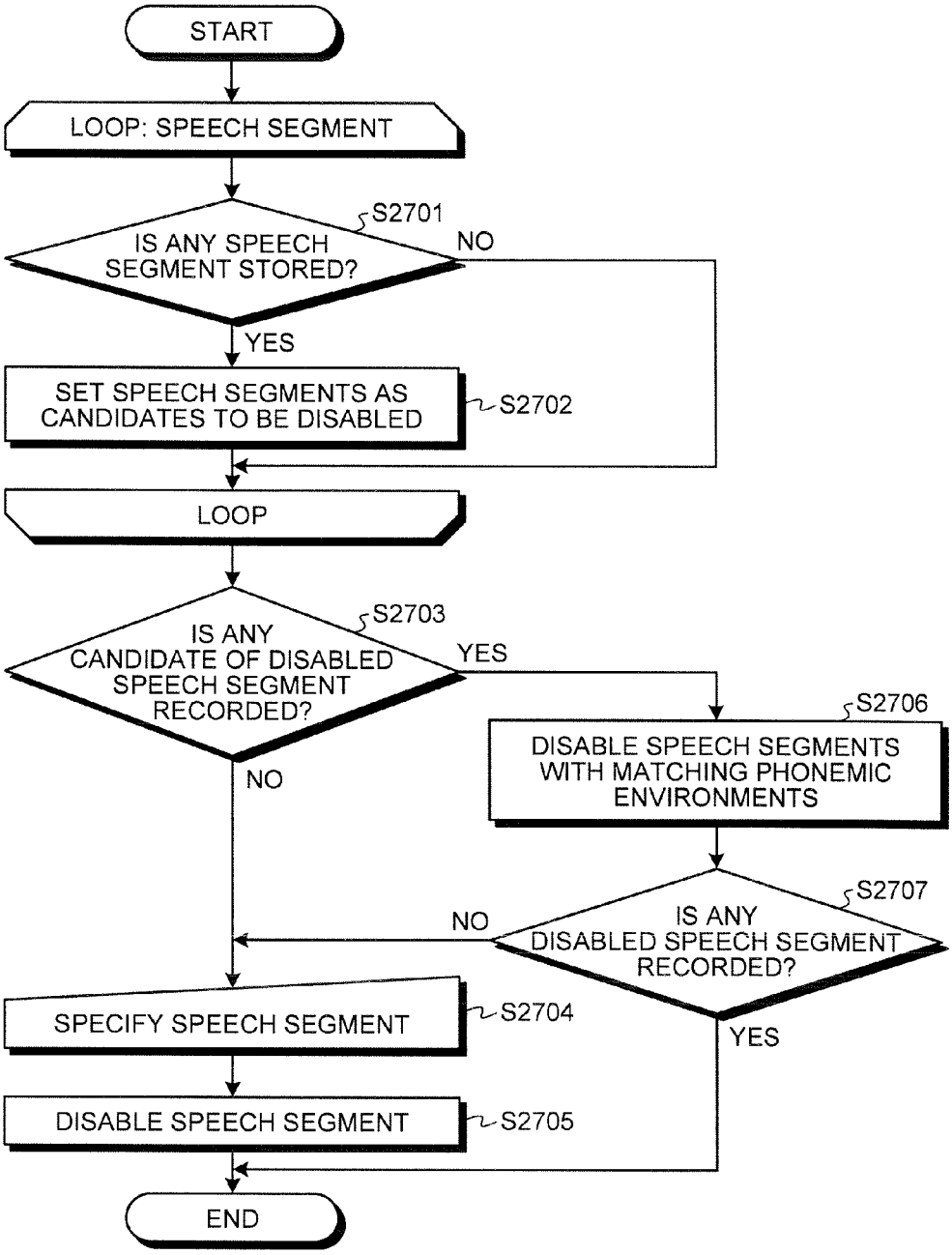
FIG. 23 is a diagram illustrating the flow chart showing the operation in step S408 of the connection unit according to a third embodiment.

FIG. 23 is a diagram illustrating the flow chart explaining step S408 in FIG. 4 according to the present embodiment.

The prohibition unit 146 performs step S2701 and step S2702 below for each speech segment of the speech segment sequence determined in step S407.

In step S2701, the prohibition unit 146 checks whether any speech segment is recorded in the change segment history storage unit 145 before branching off processing. If no speech segment is recorded ("NO" in step S2701), the processing proceeds to step S2703. If any speech segment is recorded ("YES" in step S2701), the processing proceeds to step S2702.

In step S2702, the prohibition unit 146 records such speech segments as candidates of speech segments (disabled speech segments) not to be used in the synthesis unit. When the above processing is completed for all speech segments ("NO" in step S2701), the processing proceeds to step S2703.

In step S2703, the prohibition unit 146 branches off processing depending on whether any candidate of disabled speech segment is recorded in step S2702. If any candidate of disabled speech segment is recorded ("YES" in step S2703), the processing moves to step S2706. If no candidate of disabled speech segment is recorded ("NO" in step S2703), the processing proceeds to step S2704.

Step S2704 and step S2705 are the same as step S2004 and step S2005 in FIG. 17 respectively and therefore, the description thereof is omitted.

In step S2706, the prohibition unit 146 selects from candidates recorded in step S2702 a candidate whose information about the phonemic environment of each candidate recorded in the change segment history storage unit 145 matches the phoneme of each synthesis unit and adjacent synthesis units thereof and records the candidate as a speech segment (disabled speech segment) not to be used in the synthesis unit. In the present embodiment, the range of synthesis units where the phonemes are compared is set to be a synthesis unit and adjacent synthesis units thereof, but phonemes of a wider range may be considered and compared. Candidates that are not recorded in the change segment history storage unit 145 are treated as not having a matching phonemic environment and are not recorded. If there is a plurality of candidates having matching phonemic environment information, all such candidates may be recorded or a candidate may be selected from such candidates by using another criterion such as the head of a list.

In step S2707, the prohibition unit 146 branches off processing depending on whether any disabled speech segment is recorded in step S2706. If any disabled speech segment is recorded ("YES" in step S2707), the prohibition unit 146 terminates the processing described in the flow chart before proceeding to step S401 in FIG. 4. If no disabled speech segment is recorded or no disabled speech segment could be decided in step S2706 ("NO" in step S2707), the processing proceeds to step S2704. In step S2704, like in the first embodiment, the specifying unit 144 requests and causes the user to select at least one speech segment to be disabled from the speech segment sequence determined in step S407 of FIG. 4. Next, in step S2705, like step S2706, the prohibition unit 146 records the speech segment the user selects in step S2704 as a disabled speech segment as a speech segment not to be used. Disabled speech segments recorded in step S2705 or step S2706 in this manner are referred to in step S501 of FIG. 5 and are not selected for the corresponding synthesis unit in step S502 of FIG. 5. Thus, like in the first embodiment, when the next synthetic speech is created, synthetic speech that does not use such speech segments will be created.

A concrete example of the change segment history storage unit 145 and the prohibition unit 146 will be described with reference to FIGS. 24 to 28. It is assumed that the change segment history storage unit 145 is in a state after a concrete example in the second embodiment being carried out in the present embodiment and in a state of FIG. 24. The description begins after the user enters, for example, Japanese text 400 as illustrated in FIG. 25A" (in English, it means that "a movie in which Ohguri plays the leading part was released") subsequent to the Japanese text 100 as illustrated in FIG. 7, the Japanese text 200 as illustrated in FIG. 13A, and the Japanese text 300 as illustrated in FIG. 19A and listens to synthetic speech thereof to specify that quality thereof is not acceptable and specify the word 410 as a degraded site (FIG. 25B) via the specifying unit 144.

In step S407, as illustrated in FIG. 26, the specifying unit 144 identifies a partial sequence of speech segments X, X, D, L, Y, Z, α and β corresponding to the word 410 as illustrated in FIG. 25A. It is assumed here that the defective speech segment L caused quality degradation.

In step S2701, the prohibition unit 146 checks whether any speech segment is recorded in the change segment history storage unit 145 before branching off processing. If no speech segment is recorded ("NO" in step S2701), the processing proceeds to step S2703. If any speech segment is recorded ("YES" in step S2701), the processing proceeds to step S2702.

In step S2702, the prohibition unit 146 refers to, for example, the change segment history storage unit 145 in the state of FIG. 24 to store speech segments D and L as candidates of segments (disabled speech segments) not to be used in the synthesis unit for which each speech segment is selected.

In step S2703, the prohibition unit 146 proceeds to step S2706 because candidates of disabled speech segments are recorded ("YES" in step S2703). Incidentally, if no candidate of disabled speech segment is recorded ("NO" in step S2703), the processing proceeds to step S2704.

In step S2704, the specifying unit 144 displays the speech segment sequence used by the degraded site to cause the user to select the synthesis unit.

In step S2705, if the user can correctly select the speech segment in the synthesis unit /u/ corresponding to the vowel of the syllable "c" as illustrated in FIG. 25B, like in FIG. 26, the prohibition unit 146 records the corresponding speech segment L as a disabled speech segment.

In step S2706, the prohibition unit 146 refers to the change segment history storage unit 145 in the state of FIG. 24 to compare the phonemic environment of each candidate and the phonemic environment in which each candidate is used (a phoneme sequence composed of the corresponding synthesis unit and adjacent synthesis units thereof). Regarding the speech segment D, the prohibition unit 146 does not record the speech segment D because the phonemic environment inside the change segment history storage unit 145 is /q/-/g/-/u/ and the phonemic environment in which the speech segment is used is /o/-/g/-/u/ and both phonemic environments do not match. Also regarding the speech segment L, the prohibition unit 146 does not record the speech segment L because the phonemic environment inside the change segment history storage unit 145 is /g/-/u/-/w/ or /g/-/u/-/e/ and the phonemic environment in which the speech segment is used is /g/-/u/-/n/ and both phonemic environments do not match.

In step S2707, the prohibition unit 146 proceeds to step S2704 because no disabled speech segment is recorded.

Hereinafter, through processing similar to that in the first embodiment described above, like in FIG. 27A, the defective speech segment L is not selected for the vowel /u/ in the syllable "c" based on instructions from the user and the speech segment D used appropriately in the phonemic environment may be selected for the synthetic speech (corresponding to step S401). Subsequently, synthetic speech is created (corresponding to step S402) and the synthetic speech is presented to the user (corresponding to step S403). If the user finds quality of the synthetic speech created/presented in this manner acceptable (corresponding to step S405), the replaced speech segments L and Y are registered with the change segment history storage unit 145 and phonemic environments thereof are added, like in FIG. 28, as /g/-/u/-/r/ of the speech segment L and /u/-/r/-/i/ of the speech segment Y (corresponding to step S409).

Thus, according to a speech synthesizer in the third embodiment, speech segments replaced when the user recognizes quality improvement are all recorded and also information (phonemic environment) about the environment in which the speech segment is used is recorded as accompanying information. Moreover, each speech segment is disabled only if the speech segment is used in a phonemic environment indicated by the accompanying information thereof. Accordingly, only if each speech segment is used in an inappropriate environment that could cause quality degradation, the speech segment is disabled and therefore, the accuracy with which speech segments used appropriately in other phonemic environments are disabled will be lower.

Figure 29:
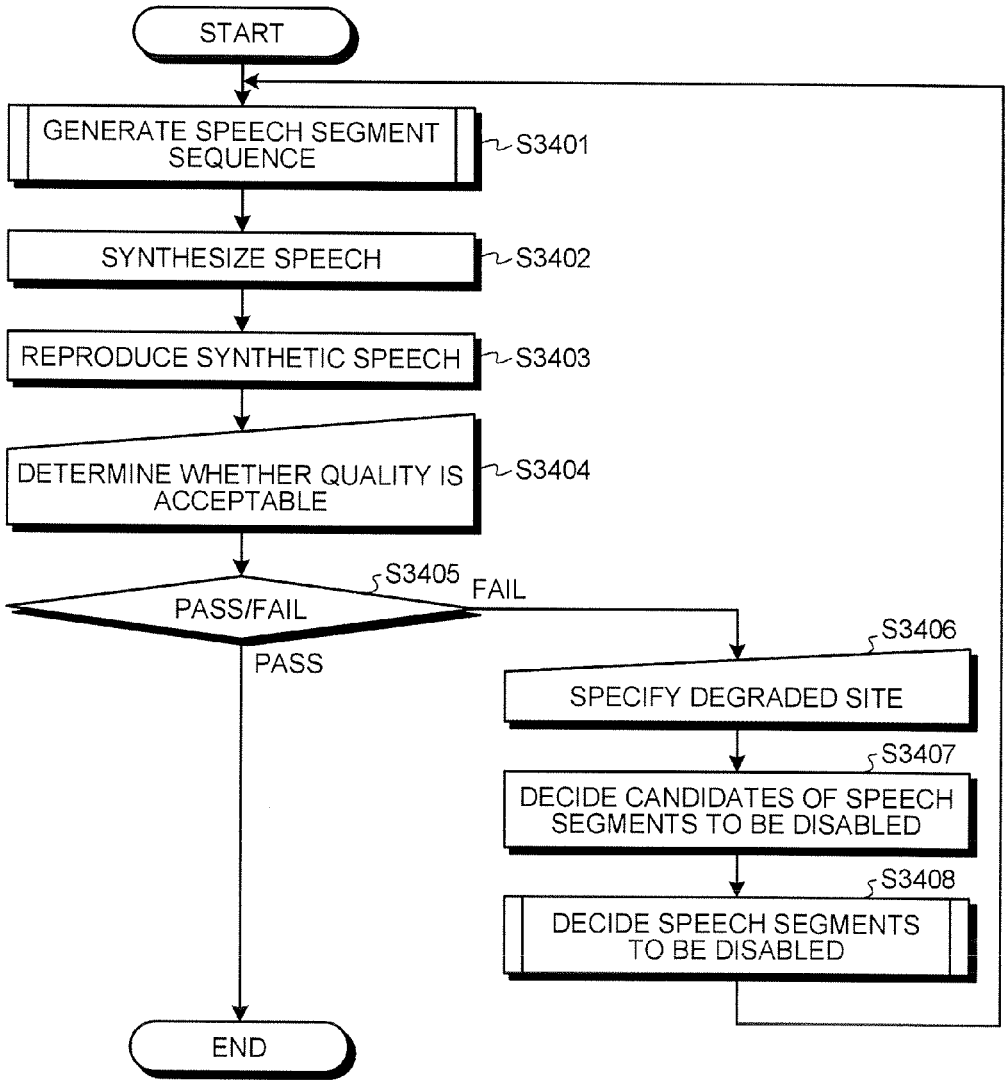
FIG. 29 is a diagram illustrating the flow chart showing the operation of the connection unit according to another embodiment.

In embodiments from the first embodiment to the third embodiment, like in steps S3401 to S3408 FIG. 29, a processing flow having no processing to record speech segments replaced before and after improvement of synthetic speech in the change segment history storage unit 145 together with accompanying information thereof can also be conceived by diverting the change segment history storage unit 145 in which a sufficiently large amount of history is recorded.

Incidentally, a speech synthesizer according to an embodiment can also be realized by, for example, using a general-purpose computer apparatus as system hardware. That is, each unit of such a speech synthesizer can be realized by causing a processor mounted on the computer apparatus to execute a program. In this case, a speech synthesizer may be realized by pre-installing the program on the computer apparatus or distributing the program stored in a storage medium such as CD-ROM or via a network to install the program on the computer apparatus when appropriate. A plurality of storage media holding speech segment data and whose data acquisition times are different can be realized by appropriately using a memory or hard disk added to the computer apparatus internally or externally or CD-R, CD-RW, DVD-RAM, DVD-R or the like.

According to the embodiments, speech segments causing quality degradation can effectively be disabled.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech synthesizer, comprising:

a generation unit that selects speech segments for respective synthesis units to generate a speech segment sequence, which is a sequence of the speech segments;

a speech connection unit that synthesizes speech by connecting the speech segments of the speech segment sequence generated by the generation unit;

a specifying unit that specifies a degraded region of a first previously synthesized speech segment sequence that is synthesized by the speech connection unit; and a prohibition unit that compares the first previously synthesized speech segment sequence with a second speech segment sequence having a same given synthesis unit as the first previously synthesized speech segment sequence, over the specified degraded region of the first previously synthesized speech segment sequence, and based on the comparison, disables a speech segment in the first speech segment sequence that is not included in the second speech segment sequence, during all subsequent selections of speech segments by the generation unit, for the given synthesis unit.

2. The speech synthesizer according to claim 1, wherein the prohibition unit stores accompanying information of the speech segment of the first speech segment sequence being disabled by the prohibition unit in a storage unit, and the prohibition unit selects the speech segment of the first speech segment sequence to be disabled based on the accompanying information stored in the storage unit.

3. The speech synthesizer according to claim 2, wherein the accompanying information contains a count of the speech segment of the first speech segment sequence being disabled by the prohibition unit.

4. The speech synthesizer according to claim 3, wherein the prohibition unit selects, from among the speech segments selected by the generation unit, a speech segment having the maximum count.

5. The speech synthesizer according to claim 2, wherein the accompanying information contains phonemes of the synthesis unit of the speech segment selected by the generation unit and surrounding synthesis units of the synthesis unit.

6. The speech synthesizer according to claim 1, wherein the specifying unit specifies the speech segment of the first speech segment sequence for each of the synthesis units, and the prohibition unit disables the speech segment of the first speech segment sequence for each of the synthesis units.

7. The speech synthesizer according to claim 2, wherein the specifying unit specifies the speech segment of the first speech segment sequence for each of the synthesis units, and the prohibition unit disables the speech segment of the first speech segment sequence for each of the synthesis units.

* * * * *